US008182611B2

(12) United States Patent
Yoo

(10) Patent No.: US 8,182,611 B2
(45) Date of Patent: May 22, 2012

(54) VACUUM CLEANING APPARATUS AND CLEANING METHOD THEREOF

(76) Inventor: Byung-Sun Yoo, Toronto (CA)

( * ) Notice: Subject to any disclaimer, the term of this patent is extended or adjusted under 35 U.S.C. 154(b) by 797 days.

(21) Appl. No.: 12/294,737

(22) PCT Filed: Mar. 14, 2007

(86) PCT No.: PCT/KR2007/001244

§ 371 (c)(1),
(2), (4) Date: Sep. 26, 2008

(87) PCT Pub. No.: WO2007/114568

PCT Pub. Date: Oct. 11, 2007

(65) Prior Publication Data

US 2010/0236577 A1 Sep. 23, 2010

(30) Foreign Application Priority Data

Mar. 30, 2006 (KR) ..... 10-2006-0028919

(51) Int. Cl.
*B08B 5/04* (2006.01)

(52) U.S. Cl. ..... 134/21; 134/34; 134/37

(58) Field of Classification Search ..... None
See application file for complete search history.

(56) References Cited

U.S. PATENT DOCUMENTS

| | | | | |
|---|---|---|---|---|
| 5,177,833 | A * | 1/1993 | Brodsky | 15/310 |
| 5,839,455 | A * | 11/1998 | Turner et al. | 134/57 R |
| 6,105,202 | A * | 8/2000 | Grasso et al. | 15/319 |

FOREIGN PATENT DOCUMENTS

| | | |
|---|---|---|
| EP | 0235934 | 1/1987 |
| EP | 0357572 | 7/1989 |
| JP | 090061092 | 3/1997 |
| JP | 1995213486 | 3/1997 |
| KR | 200155074 | 9/1999 |
| KR | 2020040025223 | 9/2004 |
| KR | 200370486 | 12/2004 |

OTHER PUBLICATIONS

International Search Report and Written Opinion dated Jun. 25, 2007 in International Patent Application No. PCT/KR2007/001244.
Korean Office Action dated Oct. 23, 2007 issued in related Korean Patent Application No. 20060028919.

* cited by examiner

*Primary Examiner* — Michael Kornakov
*Assistant Examiner* — Ryan Coleman
(74) *Attorney, Agent, or Firm* — Grossman Tucker Perreault & Pfleger, PLLC

(57) ABSTRACT

The invention relates to a cleaning method, and in particular, to a vacuum cleaning apparatus and a vacuum cleaning method thereof. A vacuum cleaning method comprising (a) positioning a dust receiver joined to one end of a vacuum suction device in the vicinity of the object of cleaning, (b) positioning a spray nozzle joined to one end of an air spray system adjacent to the object of cleaning, (c) operating the vacuum suction device, and (d) removing the foreign substances adhered to a surface of the object of cleaning by adjusting the pneumatic pressure of the air sprayed from the spray nozzle, may efficiently remove foreign substances adhered to the object of cleaning located in a narrow space.

3 Claims, 3 Drawing Sheets

[Fig. 1]
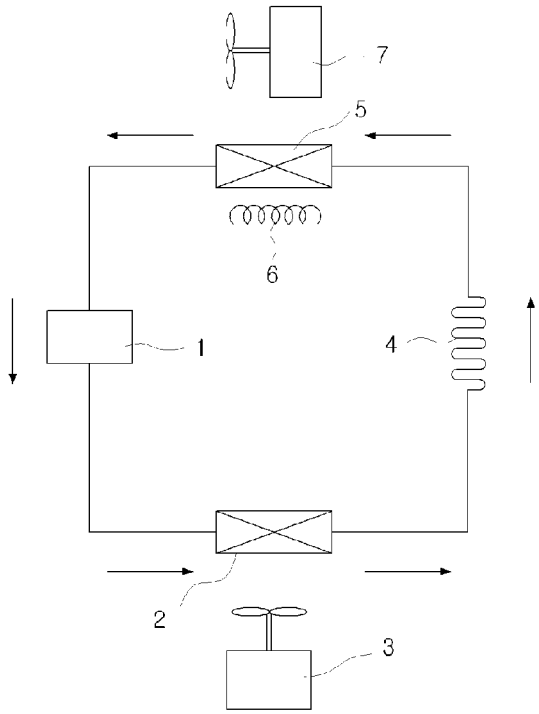
[Fig. 2]
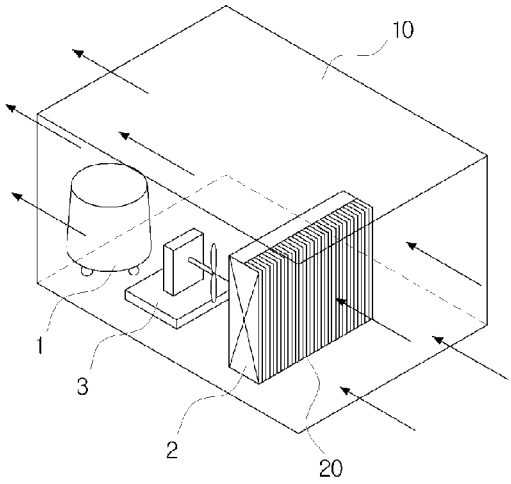
[Fig. 3]
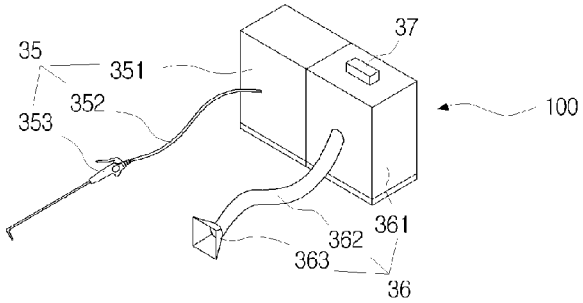

[Fig. 4]
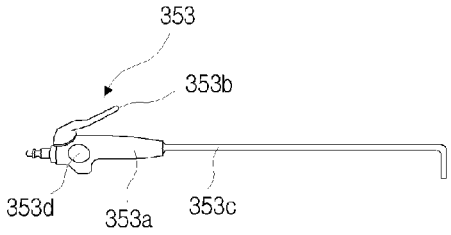
[Fig. 5]
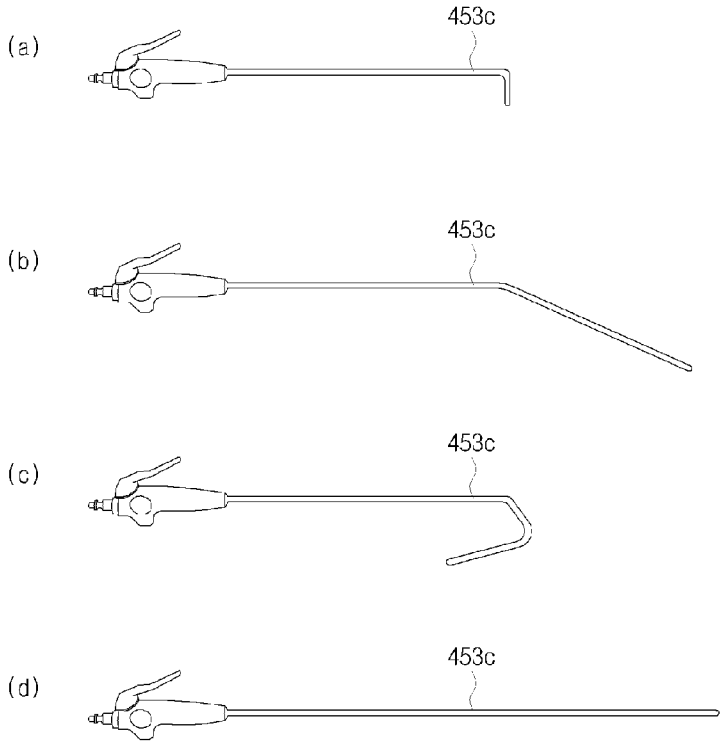
[Fig. 6]
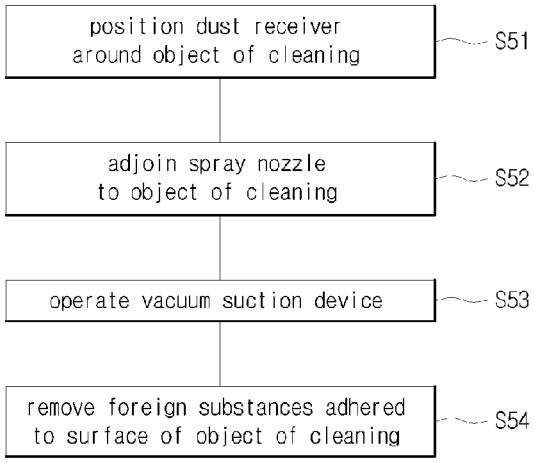

[Fig. 7]
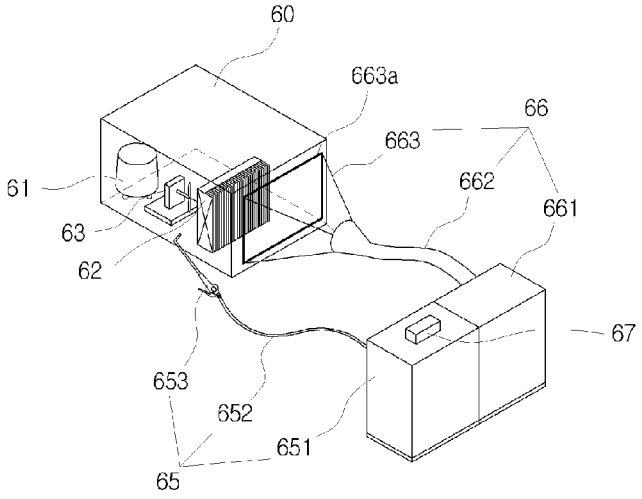
[Fig. 8]
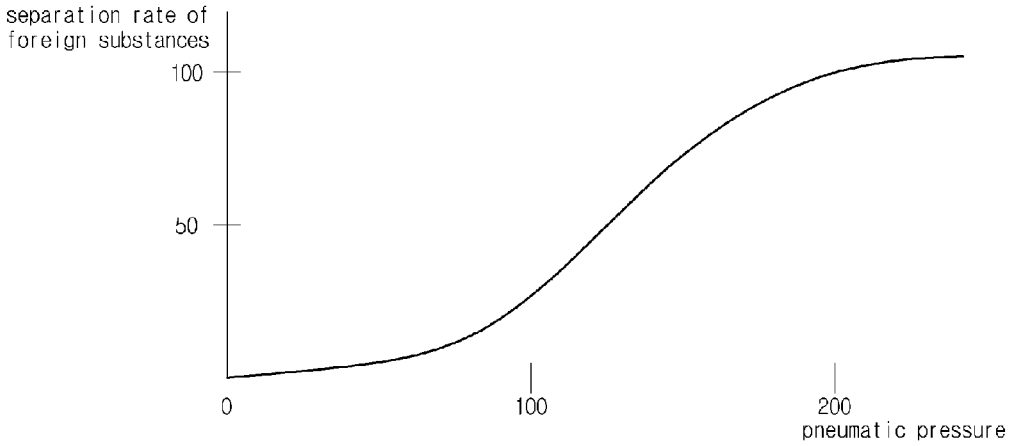

VACUUM CLEANING APPARATUS AND CLEANING METHOD THEREOF

TECHNICAL FIELD

The present invention relates to a cleaning method, and more particularly to a vacuum cleaning apparatus and a cleaning method thereof.

BACKGROUND ART

A refrigeration apparatus such as a refrigerator or an air-conditioner is an electronic product commonly used in a store merchandising goods or in the home. However, the heat transfer system (for example, the condenser) of such a refrigeration apparatus is installed so that a user cannot readily separate it for cleaning.

As shown in FIG. 1, the basic components of a refrigeration apparatus generally include the compressor 1, the condenser 2, the condenser ventilation fan 3, the capillary tube 4, the evaporator 5, the heater 6, and the evaporator ventilation fan 7. As shown in FIG. 2, the installation positions of the condenser ventilation fan 3, the compressor 1, and the condenser 2 are generally in the lower part of the main body of the refrigeration apparatus.

As time passes, foreign substances such as dust accumulate on the surface of condenser 2. As dust covers the surface of the condenser 2, it acts as an insulating material, to decrease heat exchange in the condenser 2. Consequently, much more electrical energy is needed to maintain the same degree of refrigeration as when there is no dust accumulated. In the summer seasons, this may cause malfunctions in the compressor 1 due to overloading of the condenser 2.

Furthermore, products using the heat exchange system such as air-conditioners and refrigerators consume a lot of energy, and are a major cause of power shortages in the summer seasons. It is not effective in terms of cost and energy management to build a new power plant in order to resolve these power shortages of the peak seasons.

A fan is attached in the vicinity of the condenser 2 to draw in outside air. This causes dust from outside to accumulate on the surface of the condenser 2.

To improve this problem, a method is being utilized for cleaning the condenser 2 using an acid solution and water. However, this method has the disadvantages not only of shortening the durability of the metallic condenser 2, but also of incurring high costs.

DISCLOSURE OF INVENTION

Technical Problem

Aspects of the present invention aim to provide a vacuum cleaning method and apparatus which effectively remove foreign substances from a surface of an object located in a narrow space.

Technical Solution

One aspect of the present invention provides a vacuum cleaning method, which may comprise (a) positioning a dust receiver joined to one end of a vacuum suction device in the vicinity of the object of cleaning, (b) positioning a spray nozzle joined to one end of an air spray system adjacent to the object of cleaning, (c) operating the vacuum suction device, and (d) removing the foreign substances adhered to a surface of the object of cleaning by adjusting the pneumatic pressure of the air sprayed from the spray nozzle.

In the removing of the foreign substances (operation d), it may be preferable that the more the spray direction of the air sprayed from the spray nozzle is directed toward the dust receiver, the more the pneumatic pressure is increased. Here, it may be preferable that the pneumatic pressure be controlled within a range of 100 psi to 230 psi. This may make it easier for the air sprayed in a high pressure and the dust included in the air to be sucked through the dust receiver.

Preferably, the removing of the foreign substances (operation d) may further include adjusting the output of the vacuum suction device by a controller in proportion to the pressure of the air sprayed from the spray nozzle.

Another aspect of the present invention provides a vacuum cleaning apparatus, which includes an air spray system, a vacuum suction device, and a controller. The air spray system may include an air supply device, a spray hose joined to the air supply device, and a spray nozzle joined to an end of the spray hose. Also, the vacuum suction device may include a vacuum generator, a vacuum hose joined to the vacuum generator, and a dust receiver joined to an end of the vacuum hose. The controller included in the vacuum cleaning device may control the output of the vacuum generator in proportion to the pneumatic pressure of the air sprayed from the spray nozzle.

Further, it may be preferable that the spray nozzle include a body portion, a pressure switch joined to the body portion, a pressure control lever, and a spray pipe installed on an end of the body portion. The pressure control lever may be combined with the body portion and may control the pneumatic pressure. Moreover, the form of the spray pipe may include one or more of an "L"-shape, a linear shape, a "U"-shape, and an inclined angle shape.

BRIEF DESCRIPTION OF THE DRAWINGS

FIG. 1 illustrates the configuration of a refrigeration apparatus according to prior art.

FIG. 2 illustrates the configuration of the lower part of the main body of a refrigeration apparatus according to prior art.

FIG. 3 is a perspective view of a vacuum cleaning apparatus according to a first preferred embodiment of the present invention.

FIG. 4 is a side elevation view of a spray nozzle according to a second preferred embodiment of the present invention.

FIG. 5 is a side elevation view of a spray nozzle according to a third preferred embodiment of the present invention.

FIG. 6 is a flowchart of a vacuum cleaning method according to a fourth preferred embodiment of the present invention.

FIG. 7 illustrates an example of applying a vacuum cleaning method according to a fifth preferred embodiment of the present invention.

FIG. 8 is a graph illustrating the results of an experiment on the separation rate of foreign substances with respect to pneumatic pressure according to a sixth preferred embodiment of the present invention.

DESCRIPTION OF REFERENCE NUMERALS FOR KEY ELEMENTS

35: air spray system 36: vacuum suction device
37: controller 351: air supply device
352: spray hose 353: spray nozzle
361: vacuum generator 362: vacuum hose
100: vacuum cleaning apparatus Mode for the Invention The descriptions set forth below merely illustrate the principles of the present invention. Therefore, those skilled in the art could devise various methods and apparatus thereof which realize the principles of the present invention and which do not depart from the spirit and scope of the present invention, even though they may not be clearly explained or illustrated in the present specification. Also, it is to be appreciated that not only the principles, viewpoints, and embodiments of the present invention, but all detailed descriptions listing the particular embodiments are intended to include structural and functional equivalents.

Other objectives, particular advantages, and novel features of the present invention will further be clarified by the detailed descriptions and preferred embodiments set forth below with reference to the accompanying drawings. In the describing the invention, detailed explanation of the prior art will be omitted when it is deemed to unnecessarily obscure the crux of the invention. Numerals used in the descriptions (for example, a first, a second, etc.) are merely used to distinguish equal or similar items in an ordinal manner.

FIG. 3 is a perspective view of a vacuum cleaning apparatus according to a first preferred embodiment of the present invention. In FIG. 3 are illustrated an air spray system 35, an air supply device 351, a spray hose 352, a spray nozzle 353, a vacuum suction device 36, a vacuum generator 361, a vacuum hose 362, and a dust receiver 363.

As shown in FIG. 3, the air spray system 35 comprises an air supply device 351, a spray hose 352, and a spray nozzle 353. The air supply device 351 is an apparatus for creating high-pressure compressed air. It is preferable that the air supply device 351 create a pneumatic pressure of 200 psi or greater. This is because using a low pneumatic pressure may not be able to remove dust from the condenser surface. The spray hose 352 is an apparatus for delivering the air generated in the air supply device 351 to the spray nozzle 353. It is preferable that the spray hose 352 be made of a flexible material.

The spray nozzle 353, illustrated in FIG. 4, comprises a body portion 353*a*, a pressure switch 353*b*, a spray pipe 353*c*, and a pressure control lever 353*d*. The body portion 353*a* is formed so that an operator may easily hold it. When the pressure switch 353*b* is pressed, the high-pressure air created in the air supply device 351 is sprayed through the spray pipe 353*c*. The pneumatic pressure can be controlled by the pressure control lever 353*d*. Meanwhile, the form of the spray pipe 353*c* may be varied as needed. The end of spray pipe 353*c* may be bent in an "L"-shape as illustrated in (a) of FIG. 5, bent in a particular angle as illustrated in (b) of FIG. 5, bent in a "U"-shape as illustrated in (c) of FIG. 5, or may be linear as illustrated in (d) of FIG. 5. These variations may be used to effectively clean a condenser located in a narrow space. Moreover, it may be preferable that the end of the spray pipe 353*c* be flat, being less than about 3 mm, in order to pass through the heat conduction plates, which are spaced in intervals of about 5 mm.

The vacuum suction device 36 of FIG. 3 comprises a vacuum generator 361, a vacuum hose 362, and a dust receiver 363. The vacuum generator 361 plays the role of forming a vacuum by means of the operation of a built-in motor. It may be preferable to use a high-performance vacuum generator 361 of 25 HP or greater. The pneumatic pressure of the air sprayed from the spray pipe 353*c* is important, but what is more important is the performance of the vacuum generator 361 of effectively sucking in the dust and the sprayed air. When the performance of the vacuum generator 361 is insufficient, the indoor space in which the cleaning is performed will rapidly be polluted by the dust.

Preferably, a vacuum hose 362 having a diameter of about 20 cm (8 in.) may be connected to the vacuum generator 361. A large hose is preferable in order to suck in a large amount of air instantly. The dust receiver 363 is joined to the end of vacuum hose 362. It is preferable that the dust receiver 363 be manufactured to correspond with the form of a condenser or the form of the cover joined to the refrigerator or air-conditioner for protecting the condenser. The opening of the dust receiver 363 in FIG. 3 has a rectangular form. The dust receiver 363 will be able to suck in the dust effectively, when the opening is larger than the exposed surface of the condenser. The air spray system 35 and vacuum suction device 36 may be combined as in the embodiment of FIG. 3, but may also be implemented as separate devices.

The controller 37 measures the pneumatic pressure of the air sprayed from the spray nozzle 353, and controls the vacuum pressure of the vacuum generator 361 based on the measured value. Here, the controller 37 adjusts the output of the vacuum generator 361 so that the vacuum suction device 36 sufficiently sucks in the air sprayed from the spray nozzle 353 and the dust. An implementation which does not include the controller 37 may not be preferable in terms of energy conservation and durability of the equipment, because the output of the vacuum generator 361 must always be kept at its maximum.

FIG. 6 is a flowchart of a vacuum cleaning method according to a fourth preferred embodiment of the present invention, and FIG. 7 illustrates an example of applying a vacuum cleaning method according to a fifth preferred embodiment of the present invention. A refrigeration chamber 60, compressor 61, condenser 62, cooling fan 63, air spray system 65, controller 67, air supply device 651, spray hose 652, spray nozzle 653, vacuum suction device 66, vacuum generator 661, vacuum hose 662, and dust receiver 663 are illustrated in FIG. 7.

Step S51 of FIG. 6 is to position the dust receiver 663 in the vicinity of the object of cleaning. As shown in FIG. 6, firstly the dust receiver 663 is positioned at one side of the condenser 62, which is the object of cleaning. The condenser 62 is a heat exchanger, of which a surface is exposed to the outside when the cover of a refrigerator or an air-conditioner is removed. Although it is desirable to position the dust receiver 663 on one side of the condenser 62 after removing the cover, the cover does not have to be removed if the performance of the vacuum suction device 66 is insufficient. Since there are a variety of shapes for the condenser 62, it may be preferable that the section of the opening 663*a* of the dust receiver 663 be broad enough to cover one side of the condenser 62.

Meanwhile, it may be preferable that the operation of the refrigerator or the air-conditioner, which is the object of cleaning, be stopped before proceeding with step S51, to disable the cooling fan 63 at the back of the condenser 62. Since the cleaning method of this embodiment takes about 5 to 10 minutes, the food inside the refrigerator is not damaged, even when the refrigerator is stopped.

Step S52 of FIG. 5 is to adjoin the spray nozzle 653 to the object of cleaning. The spray nozzle 653 is the means of spraying compressed air provided from the air supply device 651. Preferably, the compressed air may not be sprayed to the outside as long as the spray nozzle 653 is not operated by the user, even when there is electricity or any other form of energy supplied to the air supply device 651. The pneumatic pressure of the compressed air should be of such a pressure that the dust adhered to the surface of the condenser 62 is removed.

Step S53 of FIG. 5 is to operate the vacuum suction device 66. The dust receiver 663 can be positioned at one side of the condenser 632 after operating the vacuum suction device 66, but it may be preferable to operate the vacuum suction device 66 after positioning the dust receiver 663 at one side of the condenser 62, as the cleaning may be performed without the idling of the vacuum generator 661. It may be preferable that the vacuum suction device 66 use a high-performance vacuum generator 661 of 25 HP or greater to suck in the air sprayed from the air spray system 65 described below and the dust.

Step S54 of FIG. 6 is to remove the foreign substances adhered to the surface of the object of cleaning. Using the spray nozzle 653 equipped with the spray pipe 453*c* illustrated FIGS. 4*a*-4*d*, the foreign substances are removed from the condenser surface, which is the object of cleaning. As shown in FIG. 4, the spray nozzle 653 is equipped with the pressure switch 353*b* for adjusting the pneumatic pressure. The pneumatic pressure must be such that is strong enough to remove the dust adhered to the condenser 62, but it is preferable that the pneumatic pressure be maintained at such a level that does not deform parts of the condenser 62.

According to experiments, it may be preferable that the pneumatic pressure of the air sprayed from the spray nozzle 653 be controlled within a particular range. FIG. 8 is a graph illustrating the results of an experiment on the separation rate of foreign substances with respect to pneumatic pressure, which shows that the separation rate of the foreign substances adhered to the condenser 62 surface is proportionally increased when the pneumatic pressure is increased to 100 psi or greater, but when the pneumatic pressure is increased to 250 psi or greater, parts of the condenser 62 were deformed. Although this experiment was performed for about fifty condensers 62 of refrigeration apparatus used in indoor food stores, similar results are expected for other refrigeration apparatus, as the forms and materials of the condensers 62 are altogether similar.

In this embodiment, the spray nozzle 653 is controlled from 100 psi to 230 psi while performing the cleaning work, but there may be differences in the pneumatic pressure according to the adhesive force of the dust, the work environment, the condenser 62 surface, and the strength of the condenser 62 material.

An operator positions the end of the spray pipe illustrated in FIG. 4 at the condenser surface while controlling the pneumatic pressure. In particular, smooth operation may be provided for sucking the dust into the dust receiver 663 by keeping a low pressure when the air is sprayed in a direction opposite from the dust receiver 663 and by keeping a high pressure when the air is sprayed in a direction toward the dust receiver 663. That is, it may be preferable that the pneumatic pressure is increased the more the spray direction faces the dust receiver 663. If the cleaning were performed with high-pressure air facing a direction opposite to the dust receiver 663, the air containing the dust would instantly gush out in several directions to pollute the indoor space. Therefore, it may be necessary that the spray direction of the air be adjusted in correspondence with the pneumatic pressure to perform the cleaning without polluting the indoor space.

The spray pipe 353*c* is made as a metallic conduit with a small diameter, and is inserted through a gap in the refrigeration chamber 60 illustrated in FIG. 7 to spray the compressed air. In the case where the refrigeration chamber does not have such a gap, the spray pipe 353*c* is inserted through the side where the dust receiver 663 is positioned, and the compressed air is sprayed. It may be preferable that the form of the spray pipe 353*c* be selected in consideration of the form of the internal space of the refrigeration chamber 60 and the form of the condenser 62. The spray pipe 353 is detachable from the body portion 353*a* of the spray nozzle 353.

The compressed air sprayed from the spray pipe 353*c* and the foreign substances such as dust separated from the condenser 62 are sucked in through the dust receiver 636. Therefore, the condenser 62 can be cleaned without polluting the indoor air.

Meanwhile, the controller 67 adjusts the output of the vacuum suction device 66 according to the pressure of the air sprayed from the spray nozzle 653. After the controller 67 measures the pneumatic pressure of the air sprayed from the spray nozzle 653, it controls the output of the vacuum suction device 66 to sufficiently suck in the sprayed air. When the output of the vacuum suction device 66 is not controlled, the vacuum suction device 66 always has to maintain maximum output to prepare for air sprayed at maximum pneumatic pressure from the spray nozzle. However, since an operator may adjust the pneumatic pressure of the air sprayed from the spray nozzle 653 as needed, it is not desirable to maintain the maximum output without controlling the vacuum suction device 66.

While the present invention has been described with reference to preferred embodiments, it is to be appreciated that those skilled in the art can change or modify the invention without departing from the spirit and scope of the invention as set forth in the appended claims below.

Industrial Applicability

According to the present invention as set forth above, dust may effectively be removed from a surface of a condenser using an air supply device and a vacuum suction device, to increase the efficiency of heat transfer of the condenser and conserve about 5~20% of electrical energy. In addition, not only is the durability of the mechanical device enhanced, as overloading is prevented in the refrigerator or air-conditioner, etc., but also no chemicals are used for the cleaning to render it environmentally sound. Also, the cleaning process may be performed even with the condenser installed, whereby the work efficiency is increased.

The invention claimed is:

1. A vacuum cleaning method, comprising:

(a) positioning a dust receiver joined to one end of a vacuum suction device, in the vicinity of the object of cleaning;

(b) positioning a spray nozzle joined to one end of an air spray system, adjacent to the object of cleaning;

(c) operating the vacuum suction device; and (d) removing the foreign substances adhered to a surface of the object of cleaning by adjusting the pneumatic pressure of the air sprayed from the spray nozzle;

(e) while removing the foreign substances adhered to a surface of the object, moving the spray nozzle relative to the dust receiver, wherein, in the removing of the foreign substances (operation d), the more the spray direction of the air sprayed from the spray nozzle is directed toward the dust receiver, the more the pneumatic pressure is increased.

2. The method of claim 1, wherein the pneumatic pressure is controlled within a range of 100 psi to 230 psi.

3. The method according to claim 1, wherein the removing of the foreign substances (operation d) further includes adjusting the output of the vacuum suction device by a controller in proportion to the pressure of the air sprayed from the spray nozzle.

* * * * *